United States Patent [19]

Dreyfus

[11] Patent Number: 4,883,168

[45] Date of Patent: Nov. 28, 1989

[54] REINFORCING CORNER FLAP FOR GROUP PACKAGES

[75] Inventor: Roger Dreyfus, Strasbourg, France

[73] Assignee: I.C.P., S.A., Fegersheim, France

[21] Appl. No.: 227,856

[22] Filed: Aug. 3, 1988

[30] Foreign Application Priority Data

Aug. 3, 1987 [FR] France ..... 87 11100

[51] Int. Cl.[4] ..... B65D 5/04

[52] U.S. Cl. ..... 206/152; 206/154

[58] Field of Search ..... 206/152, 154

[56] References Cited

U.S. PATENT DOCUMENTS

| | | | |
|---|---|---|---|
| 2,768,741 | 10/1956 | Currie | 206/154 |
| 2,849,112 | 8/1958 | Forrer | 206/154 X |
| 2,872,036 | 2/1959 | Forrer | 206/154 |
| 3,128,034 | 4/1964 | Weiss | 206/154 X |
| 3,229,892 | 1/1966 | Weiss | 206/152 X |

*Primary Examiner*—William Price

*Attorney, Agent, or Firm*—Schwartz & Weinrieb

[57] ABSTRACT

A protective and reinforcing corner flap for group package of the wrapping type, especially six-packs, for various types of contents such as bottles and cans. The flap provides a foldable piece during the cutting of the end cutouts which folds up against the connecting strip to double it.

19 Claims, 2 Drawing Sheets

FIG. 2
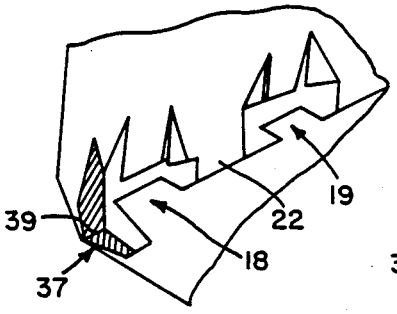
FIG. 1
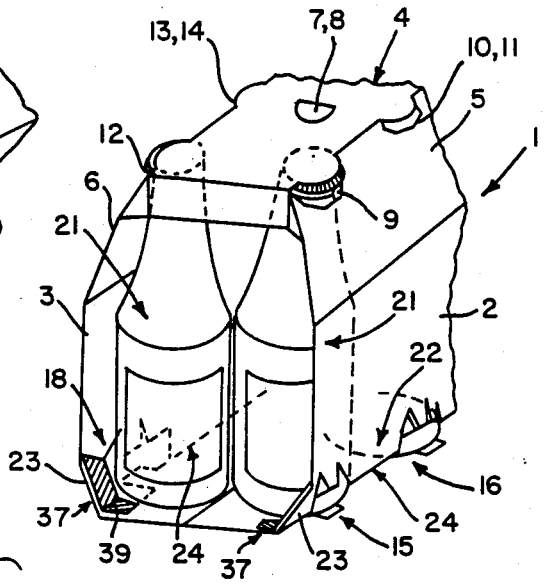
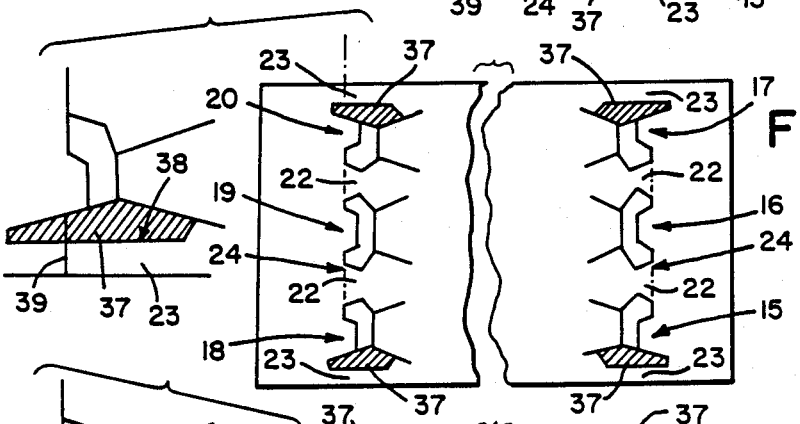
FIG. 3
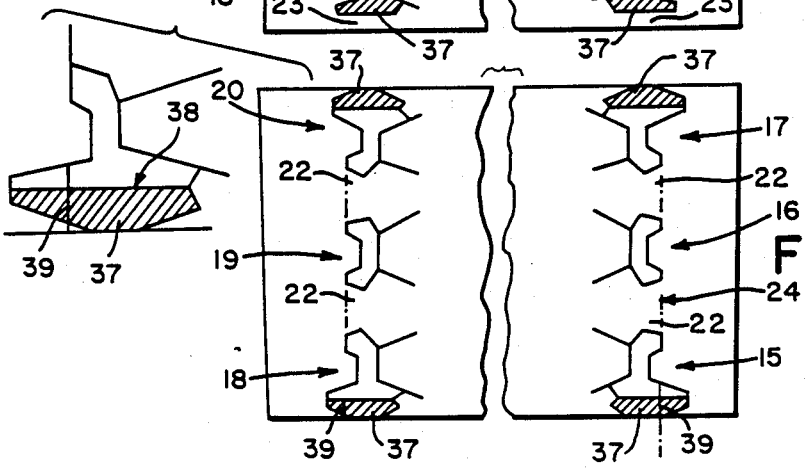
FIG. 4

REINFORCING CORNER FLAP FOR GROUP PACKAGES

This invention concerns a protective and reinforcing flap for group packages of the wrapping type, specifically cluster-packs, intended for various types of containers.

The present means of production of mass-consumption products and the associated packaging machines permit high rates of production.

This is the case for the filling, capping, and packaging in small group units of beverage bottles, especially beer.

Thus, the packaging is done continuously on products that are still warm, leaving the pasteurizers.

While the heat radiated by the bottles does not interfere with the packaging step, it constitutes a real drawback in the following phase of temporary storage.

Actually, the formed packages are placed on pallets directly and immediately after leaving the packaging equipment.

For reasons of efficiency, the heat-shrinkable plastic film retaining covers are put in place at the end of the chain.

The packages thus loaded on pallets and retained are moved to warehouses in which the ambient temperature is significanlly lower.

Since the drying of the air can not be provided for in an industrial environment, the inevitable phenomenon of condensation occurs inside the hot volume confined by the plastic covers in spite of the existence of perforated covers which are inadequate for eliminating this phenomenon.

This condensation produces an amount of water that is not negligible in the packages, which can be enough to run along the faces, especially the internal faces of the walls, and to accumulate at the bottom of the package, and then to flow into the lower package in a stack. Because of the shape of the bottles, this trickling more particularly reaches the connecting strips of cardboard separating the end cutouts and weakens the strength of the cardboard, and accordingly of the package at these points.

This lower mechanical strength proves to be particularly sensitive at the connecting strips of small width, such as those located at the end, which are then in danger of breaking at the bottom fold, i.e., at the longitudinal fold between the side face and the bottom panel.

These strips hold the end bottles. Their tearing or breakage causes the end bottles to fall out, then very often followed by the bursting of the package, i.e., very frequently its destruction with loss of its contents.

The purpose of this invention is effectively to correct these various drawbacks by a simple and rapid means to be used in preparing the packages.

To this end, it concerns a protective and reinforcing corner flap for group packages of the wrapping type, especially clusterpacks, for various types of contents, bottles and others, characterized by the fact that it provides a foldable piece or flap during the cutting of the end cutouts, which folds up against the end connecting strip to double it.

Numerous benefits are derived from this invention, principally the following:

- protection of the narrow end connecting strip against water of condensation
- reinforced protection of the cardboard as a trickle surface reinforced by the printed and varnished surface
- simplicity of manufacture
- no added cost since this invention does not involve any increase of the surface area of the pack, which is not the case with known methods
- ease of implementation by present mechanical equipment.

The technical characteristics and other benefits of the protective and reinforcing corner flap pursuant to the invention are given in the following description, which is given by way of nonlimiting example for two methods of implementation with reference to the accompanying drawings, in which:

FIG. 1 is a perspective view with cutaway of a package to hold containers of the bottle type including protective and reinforcing flaps pursuant to the invention;

FIG. 2 is a detailed perspective view showing one end provided for the flap pursuant to the invention;

FIGS. 3 and 4 are plan views of the cutting, broken apart in the central section, in its simplified version, showing the protective end flaps before and after folding;

This invention proceeds from the general inventive concept which consists of creating a flap near each end connecting strip at the bottom and possibly at the top of the package, by the partial use of an area customarily cut away, whose folding around a parallel line at the adjacent edge of the cutout simultaneously provides a plane of protection of the aforesaid strip against water of condensation and reinforces it by doubling the cardboard thickness.

Preferably, the flap is perpendicular to the bottom fold of the package and extends on both sides of it.

Figure 5:
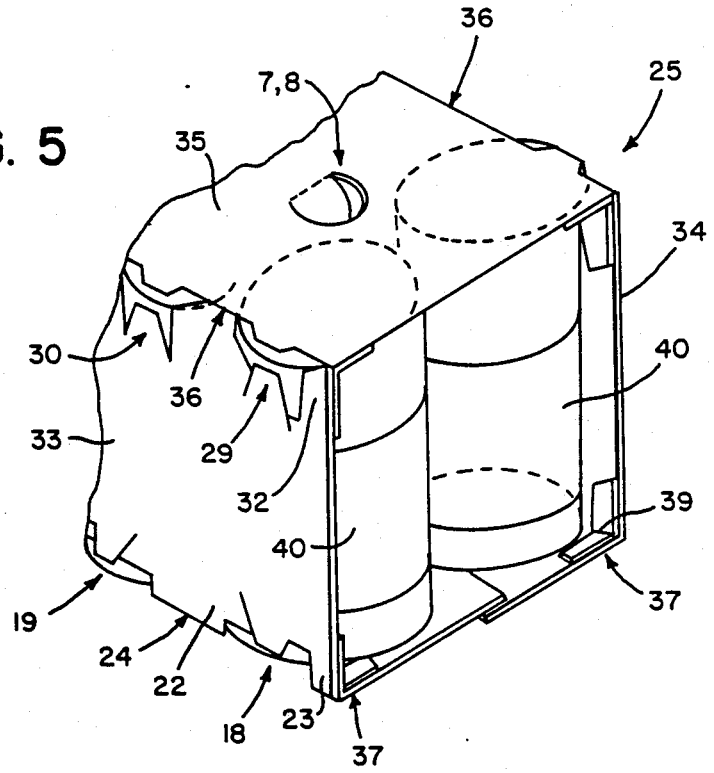
FIG. 5 is a perspective view of the end of a simplified package to hold cylindrical containers including protective and reinforcing flaps pursuant to the invention at the top and bottom.
Figure 6:
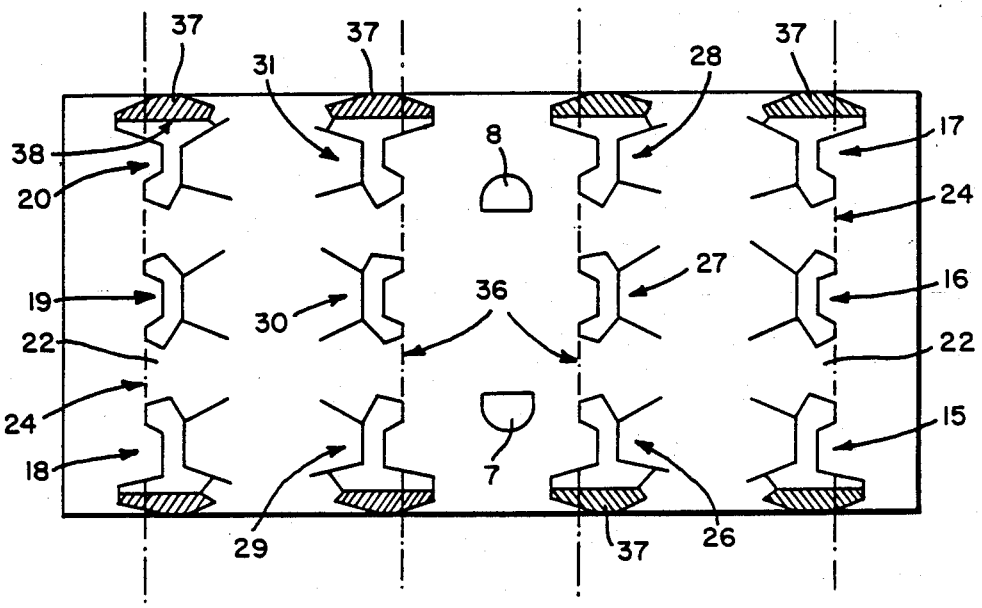
FIG. 6 is a flat view of the cutting of the package shown in FIG. 5.

By way of example, the invention is applied to a package of the cluster-pack type such as that shown in FIGS. 1 and 5.

It is understood that other forms of packages may be suitable provided that the general shape of the containers permits wrapping them with retaining cutouts.

The package has a body 1 in the general shape of a parallelepiped, which is known, comprising for example two side walls 2 and 3 connected to an upper surface panel 4 by two slanted sections 5 and 6 with two cuts 7 and 8 constituting the finger holds (FIG. 1). In the upper section of the slanted panels 5 and 6, the body of the package has retaining notches 9, 10, 11 and 12, 13, 14 for the caps or necks.

In the lower section of its side walls, as an extension into its bottom, the package has retaining cutouts from 15 to 20 for the bottom of the containers, for example bottles such as 21, with the cutouts separated by intermediate connecting strips such as 22 and narrower end strips 23, separated from the bottom panel by a lower connecting fold called the base fold 24.

A package with a parallelepiped body 25 of simpler construction is shown in FIG. 5. In this package, there are upper cutouts indicated by 26 to 31 separated by intermediate upper connecting strips and end connecting strips 32.

This package includes side panels 33 and 34 and an upper surface panel 35 separated by two upper connecting folds such as 36.

The invention also applies to this type of package and to others of the same, similar, or approximate configuration.

The common elements are given the same reference numbers.

Thus, the lower retaining cutouts from 15 to 20 can be seen, separated by intermediate connecting strips such as 22 and end strips 23.

In accordance with the invention, during the cutting of the end cutouts, an area not to be discarded is provided for, represented by a foldable piece that can bend on the adjacent lateral edge of the cutout. This piece forms a protective and reinforcing flap 37 extending on both sides of the base fold 24. This flap is folded entirely against the adjacent end connecting strip 23 by pivoting around a fold 38 preferably parallel to the outer edge of the end strip, thus providing not only protection but mechanical reinforcement by doubling.

The base fold 24 passes across the flap, and after the pivoting, it is around the fold 38 as an extension of the line of the base fold 24, to provide for the connection of the adjacent side panels and the base (FIG. 2) since the transverse fold 39 that each flap 37 shows is a segment of the aforesaid base fold 24.

The flap can be glued against the adjacent connecting strip, thus providing better mechanical reinforcement by total combination of the two thicknesses.

Protection against moisture and trickling from condensation is improved further by the external surface of the flap, which corresponds to the printed and varnished surface of the package, which is more resistant since it benefits from the surface treatment originating from the printing and varnishing.

Preservation of all of the original peformance of the package up to the consumer is thus assured.

Furthermore, the products palletized in this way are more stable during transport, avoiding any risk of buckling.

As stated previously, with reference to FIG. 5, the protective and reinforcing flap pursuant to the invention also applies to the top of a package of cylindrical cans such as 40.

The shape and the folds, respectively, are identical. In this type of package there are also upper flaps, identical to the lower flaps, hinged and extending in the same way on both sides of the upper connecting folds such as 35.

The corner reinforcement produced at the top end of the package plays a protective role against trickling originating from the upper package in a stack. It also plays a protective role against damage due to moisture.

It is understood that the invention is independent of the precis and exact shape of the flap. Thus, different variations of shape have proved possible, provided that the essential functions are preserved.

I claim:

1. Protective and reinforcing flap means incorporated within a wrapping type package for housing a plurality of containers, wherein said package includes cut-out means, for retaining said plurality of containers within said package, formed within bottom and sidewall panels of said package and extending across fold lines defined between said bottom and sidewall panels of said package; intermediate connecting strips interconnecting said bottom and sidewall panels of said package by extending across said fold lines defined between said bottom and sidewall panels of said package, and separating said cut-out means; and end strips interconnecting said sidewall and bottom panels of said package by extending across said fold lines defined between said bottom and sidewall panels of said package, and interposed between end ones of said cut-out means and exterior side edges of said package, said protective and reinforcing flap means comprising:

a flap formed within each one of said end cut-out means and interconnecting said bottom and sidewall panels of said package by extending across said fold lines defined between said bottom and sidewall panels of said package;

fold line means defined between each one of said flaps and each one of said end strips for permitting each one of said flaps to be folded over each one of said end strips whereby an outer edge portion of each one of said folded flaps is substantially aligned with an outer edge portion of each one of said end strips which define said exterior edges of said package such that said end strips of said package, within the vicinity of said containers and within corners of said package as defined along said fold lines between said bottom and sidewall panels of said package, are reinforced by means of a double-thickness of material forming said package panels; and means for bonding each one of said flaps to each one of said end strips so as to secure each one of said flaps to each one of said end strips so as to insure said double-thickness reinforcement of said package within said exterior edge regions of said package.

2. Protective flap means as set forth in claim 1, wherein:

said containers housed within said package comprise cans.

3. Protective flap means as set forth in claim 1, wherein:

said containers housed within said package comprise bottles.

4. Protective flap means as set forth in claim 1, wherein:

said package includes cut-out means, intermediate connecting strips, and end strips formed within top and sidewall panels of said package and extending across fold lines defined between said top and sidewalls panels so as to substantially positionally correspond to said cut-out means, said intermediate connecting strips, and said end strips formed within said bottom and sidewall panels of said package;

a flap formed within each one of said end cut-out means and interconnecting said top and sidewall panels of said package by extending across said fold lines defined between said top and sidewall panels of said package, fold line means defined between each one of said flaps and each one of said end strips of said top and sidewall panels for permitting each one of said flaps of said top and sidewall panels to be folded over each one of said end strips of said top and sidewall panels whereby an outer edge portion of each one of said folded flaps of said top and sidewall panels is substantially aligned with an outer edge portion of each one of said end strips of said top and sidewall panels of said package which define said exterior edges of said package such that said end strips of said package, within the vicinity of said containers and within corners of said package as defined along said fold lines between said top and sidewall panels of said package, are reinforced by means of a double-thickness of material forming said package panels; and means for bonding each one of said flaps to each one of said end strips of said top and sidewall panels of said package so as to secure each one of said flaps to each one of said end strips of said top and sidewall panels of said package so as to insure said double-thickness reinforcement of said package within said exterior edge regions of said package extending between said top and sidewall panels of said package.

5. Protective flap means as set forth in claim 4, wherein:

said containers within said package comprise cans.

6. Protective flap means as set forth in claim 1, wherein:

said package is fabricated from cardboard.

7. Protective flap means as set forth in claim 4, wherein:

said package is fabricated from cardboard.

8. Protective flap means as set forth in claim 1, wherein:

said fold line means are disposed substantially parallel to said exterior edges of said package.

9. Protective flap means as set forth in claim 4, wherein:

said fold line means within said top and sidewall panels of said package are disposed substantially parallel to said exterior edges of said package within said top and sidewall panels of said package.

10. Protective flap means as set forth in claim 1, wherein:

said flaps are disposed substantially perpendicular to said fold lines defined between said bottom and sidewall panels said package.

11. Protective flap means as set forth in claim 4, wherein:

said flaps are disposed substantially perpendicular to said fold lines defined between said top and sidewall panels of said package.

12. Protective flap means as set forth in claim 1, further comprising:

fold means defined within each of said flaps so as to permit said flaps to be folded along with said bottom and sidewall panels of said package.

13. Protective flap means as set forth in claim 12, wherein:

said fold means are co-linear with said fold lines defined between said bottom and sidewall panels of said package.

14. Protective flap means as set forth in claim 4, further comprising:

fold means defined within each one of said flaps of said top and sidewall panels of said package so as to permit said flaps to be folded along with said top and sidewall panels of said package.

15. Protective flap means as set forth in claim 14, wherein:

said fold means are co-linear with said fold lines defined between said top and sidewalls panels of said package.

16. Protective flap means as set forth in claim 12, wherein:

said fold means are disposed substantially perpendicular to said fold line means.

17. Protective flap means as set forth in claim 14, wherein:

said fold means are disposed substantially perpendicular to said fold line means of defined between said top and sidewall panels of said package.

18. Protective flap means as set forth in claim 1, wherein:

said flap each have the configuration of a pentagon.

19. Protective flap means as set forth in claim 4, wherein:

each of said flaps operatively associated with said top and sidewall panels of said package has the configuration of a pentagon.

* * * * *